US005651270A

United States Patent [19]

Low et al.

[11] Patent Number: 5,651,270

[45] Date of Patent: Jul. 29, 1997

[54] CORE-IN-SHELL HEAT EXCHANGERS FOR MULTISTAGE COMPRESSORS

[75] Inventors: William R. Low; Kenneth C. Campbell, both of Bartlesville, Okla.

[73] Assignee: Phillips Petroleum Company, Bartlesville, Okla.

[21] Appl. No.: 682,463

[22] Filed: Jul. 17, 1996

[51] Int. Cl.[6] ..... F25J 1/00

[52] U.S. Cl. ..... 62/613; 62/657

[58] Field of Search ..... 62/612, 613, 657

[56] References Cited

U.S. PATENT DOCUMENTS

| | | | |
|---|---|---|---|
| 3,413,817 | 12/1968 | Kniel | 62/613 |
| 3,616,652 | 11/1971 | Engel | 62/613 |
| 4,457,768 | 7/1984 | Bellinger | 62/21 |
| 4,638,639 | 1/1987 | Marshall et al. | 62/613 |
| 4,680,041 | 7/1987 | DeLong | 62/11 |
| 4,698,080 | 10/1987 | Gray et al. | 62/21 |
| 4,758,257 | 7/1988 | Gates et al. | 62/613 |
| 4,951,475 | 8/1990 | Alsenz | 62/117 |

*Primary Examiner*—Ronald C. Capossolt

*Attorney, Agent, or Firm*—George E. Bogatie

[57] ABSTRACT

In multistage refrigeration compression, where liquid refrigerant withdraw from a core-in-shell type heat exchanger connected to a high compression stage is passed to a similar exchanger connected to a lower compression stage, liquid level stability in the higher compression stage exchanger is improved by providing an enlarged surge volume. A baffle plate transversing a lower portion of the shell divides the shell into a cooling zone that contains the cores, and a discharge zone that is part of the surge volume. The height of the baffle is selected to facilitate maintenance of at least a minimum functional liquid level in the shell. Liquid refrigerant withdraw from the discharge zone of the high-stage shell is supplied to the cooling zone of a shell connected to a lower compression stage. The liquid level in the shell is maintained by manipulating flow to liquid refrigerant that is flashed into the cooling zone of the higher compression stage shell. A refrigerant compressor may employ two or more compression stages, where the higher stage shells are typically much smaller than the lower stage shells, and the described scheme prevent major liquid level upsets in the shell of a higher stage resulting from minor liquid level upsets in the lower stage shells.

14 Claims, 2 Drawing Sheets

CORE-IN-SHELL HEAT EXCHANGERS FOR MULTISTAGE COMPRESSORS

The present invention relates to the cooling of a normally gaseous material. In a more specific aspect, this invention relates to the cryogenic cooling of a normally gaseous material. In a still more specific aspect, this invention relates to design features for improving liquid level stability of two or more plate fin core-in-shell heat exchangers in a multistage refrigerant compressor system.

BACKGROUND OF THE INVENTION

Normally gaseous materials are cooled for a variety of purposes. Cryogenic liquefaction of normally gaseous materials is utilized, for example, in separation of mixtures, purification of the component gases, storage and transportation of the normally gaseous material in an economic and convenient form, and other uses. Most such liquefaction processes have many operations in common, whatever the particular gases to be liquefied, and consequently have many of the same operating problems. One common problem is the compression of refrigerants and/or components of the normally gaseous material. Accordingly, the present invention will be described with specific reference to processing natural gas, but is applicable to processing of other gases.

It is common practice in the art of processing natural gas to subject the natural gas to cryogenic treatment to separate hydrocarbons having a molecular weight higher than methane from the natural gas. Thereby, pipeline gases predominating in methane, and a gas predominating in higher molecular weight components for other uses are produced. It is also common practice to cryogenically treat natural gas to liquefy the same for transportation and storage.

Processes for the liquefaction of natural gas are principally of two main types. The most efficient and effective type is an optimized cascade operation, and this optimized type in combination with expansion type cooling. The cascade process provides a series of refrigerants selected so as to provide only small temperature differences between the refrigeration system and the natural gas being cooled. In this manner it closely matches the cooling characteristics of the natural gas feed. By using a sequence of refrigerants the natural gas is cooled from ambient temperature as received from wells or pipelines down to about −259° F., which is typical of LNG. The second type process, which is less efficient, uses multi component refrigerant cycles to approximate the cascade process.

In the cascade-type of cryogenic production of LNG, the natural gas is first subjected to preliminary treatment to remove acid gases and moisture. Natural gas at an elevated pressure, either as produced from the wells or after compression and at approximately atmospheric temperature, is cooled in a sequence of multistage refrigeration cycles by indirect heat exchange with two or more refrigerants. For example, the natural gas is sequentially passed through multistages of a first refrigerant cycle, which employs a relatively high boiling refrigerant, such as propane. It is then passed through multi stages of a second cycle in heat exchange with a refrigerant having a lower boiling point, for example ethane or ethylene, and finally through a third cycle in heat exchange with a refrigerant having a still lower boiling point, for example methane.

In each stage of the high and intermediate cooling stages of a three-stage refrigerant compressor system, the natural gas is cooled by compressing the refrigerant to a pressure at which it can be liquefied by cooling. The liquefied refrigerant is then expanded to flash part of the liquid into the shell of a high-stage core-in-shell heat exchanger. This, of course, requires larger than normal shells for the heat exchanger. The feed gas stream passes through the core of the exchanger while the refrigerant is expanded into the shell cooling the refrigerant stream. The gaseous portion passes through the shell vapor space and exits the shell. The liquid phase is collected in the shell. The liquid phase is then circulated to contact the cores by thermosiphon circulation. Approximately 25 to 30% of the thermosiphon circulated fluid evaporates providing the cooling for indirect heat exchange with the feed gas. The heat exchanger shell can also function as separator for separating the flashed gas from the remaining liquid. Remaining liquid in the first chiller is then further expanded to flash a second portion of the liquid into an intermediate stage of the cooling cycle. The remaining liquid from the intermediate stage heat exchanger shell may be further expanded to flash a third portion of the liquid in a low stage of the cooling cycle. Accordingly, a multistage refrigeration compressor system typically includes a very large volume low stage core-in-shell heat exchanger (because of the large low-stage vapor-compression refrigeration service), and relatively small volume high and interstage core-in-shell exchangers because of the reduced vapor-compression refrigeration service required for these stages.

A problem arises in this heat exchanger configuration, however, in that small liquid level upsets in the large volume low stage shells have a very large destabilizing effect on the liquid level required for the much smaller high-stage and intermediate-stage cores.

Accordingly, it is an object of this invention to improve the apparatus and method used for cooling a normally gaseous material.

Another object of this invention is to improve operating efficiency of a multistage compression refrigeration cycle.

It is a more specific object to improve stability of refrigerant liquid levels in plate fin core-in-shell heat exchangers in a multistage compressor system.

SUMMARY OF THE INVENTION

According to the present invention, the foregoing and other objects and advantages are attained by using a multistage refrigeration compressor system having a plate fin core-in-shell heat exchanger associated with each compressor stage, and in which a portion of refrigerant liquid from each higher-stage shell is passed to the next lower-stage shell. The shell of each exchanger is sized for handling vapor-compression refrigeration service for its associated compression stage, and also functions as a gas liquid separation vessel. In addition, the high-stage and any intermediate stage shells include a weir type baffle set to hold a minimum functional liquid level for its cores. Surge volume is added behind the baffle. The added surge volume insures that the high and intermediate stage shells have a surge volume equivalent to a fluctuation in the largest down stream shell of from about four inches to about eight inches. Liquid from a higher-stage shell for supplying a lower-stage is withdrawn from the surge volume of the shell, thus preventing major liquid level upsets in the core of a higher stage shell resulting from minor upsets in the lower stages.

Other objects and advantages of the invention will be apparent to those skilled in the art from the following description of the preferred embodiment and the appended claims and the drawings in which:

DESCRIPTION OF THE PREFERRED EMBODIMENT

Figure 1:
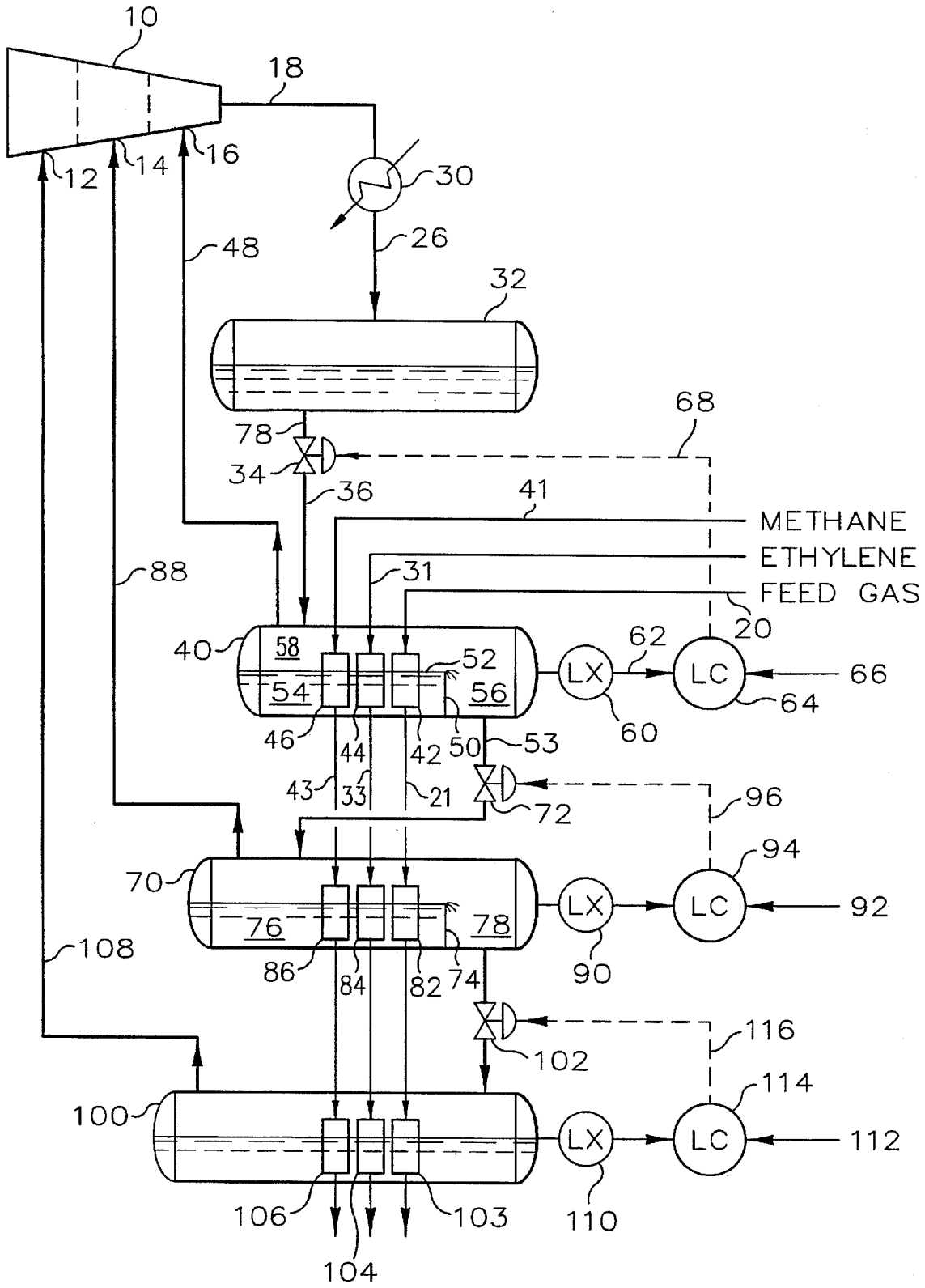
FIG. 1 is a schematic of a three-stage compressor system illustrating the practice of the invention in the processing of a natural gas stream.

Brazed-aluminum-plate-fin heat exchangers are used in the process industries, particularly in gas separation processes at cryogenic temperatures. A cascade refrigerant cryogenic process utilizing brazed-aluminum-plate fin heat exchangers is illustrated and described in U.S. Pat. No. 4,680,041, which is incorporated herein by reference. The heat exchange surfaces of these exchangers are made up of a stack of layers, with each layer consisting of a corrugated fin between flat metal sheets sealed off on two sides by channels or bars to form one passage for the flow of fluid. These exchangers are suitable for association with multistage compressors (as illustrated in FIG. 1) for use in cascade type of cooling because the surface may be arranged for countercurrent or parallel flow or both, and with several different process streams. Further these exchangers are used with gases, liquids, and liquid/vapor mixtures for sensible heat transfer, evaporation, and condensation.

Referring specifically now to FIG. 1, a preferred embodiment of the present invention is illustrated, in which a natural gas feed stream and two streams of lower boiling refrigerants are cooled in a multistage propane refrigerant compression cycle. A three-stage compressor 10 having inlets 12, 14 and 16, and a single outlet 18 is illustrated. The feed gas is introduced into the system through conduit 20. A refrigerant gas, such as gaseous propane, is compressed in the multi stage compressor 10 driven by a driver (not illustrated). The compressed propane is passed through conduit 18 and cooled to liquefy the same in condenser 30. Condenser 30 discharges liquid refrigerant to an accumulator 32 via conduit 26. The pressure of the liquid propane is then reduced, as through control valve 34, to flash a portion of the liquid propane into the high-stage propane heat exchange shell 40 thus cooling the propane stream. The gaseous portion passes through the shell vapor space and exits the shell 40 via conduit 48. The liquid portion is collected in the shell 40 to form a liquid level that is maintained at or above a minimum level illustrated at 52. The liquid in shell 40 is circulated by thermosiphon circulation to contact the cores 42, 44, and 46. Approximately 25 to 30 percent of the thermosiphon circulated fluid evaporates providing the cooling for indirect heat exchange with the natural gas feed stream via plate-fin core 42, the next lower boiling point refrigerant such as ethylene in plate-fin core 44, and a still lower boiling point refrigerant such as methane in plate-fin core 46. The evaporated gas is returned to the high stage inlet 16 of compressor 10 via conduit 48.

Figure 2:
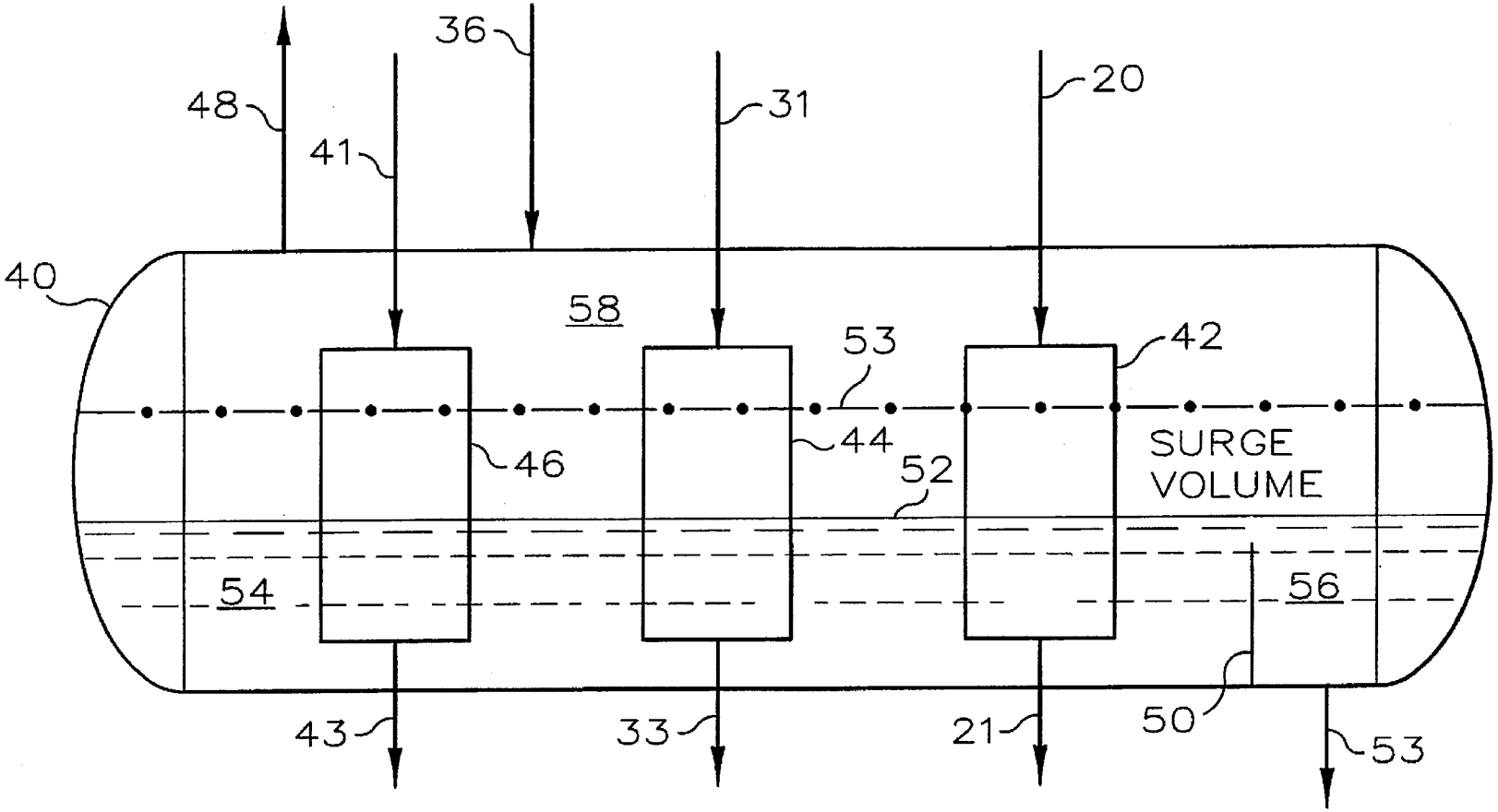
FIG. 2 is a schematic illustrating the surge volume in a heat exchange shell according to the present invention.

Referring specifically now to FIG. 2, there is better illustrated the surge volume for a high stage or intermediate stage shell such as shell 40 in FIG. 1. In FIG. 2 like reference numerals are used for the same parts illustrated in FIG. 1. A weir type baffle 50 is positioned in the shell 40 to maintain a minimum functional liquid level 52 in a part of the shell 40 identified as numeral 54. Further, the baffle 50 divides the shell 40 into a heat exchange zone and a discharge zone. As shown in FIG. 2, the surge volume added behind the baffle 50, illustrated as 56, serves as the discharge zone. As previously mentioned, the surge volume in a high stage or intermediate stage shell includes a volume equal to a fluctuation in the liquid level of the largest downstream shell preferable in a range of from about four inches to about eight inches. More preferably the surge volume is from about five inches to about seven inches, and most preferably about six inches. As best illustrated in FIG. 2, the surge volume is defined as the added surge volume 56 combined with the volume between the liquid level variations in normal operations. These normal variations, illustrated in FIG. 2, range between a minimum functional liquid level for operation of the cores such as 46 (shown at 52), and the normal operating liquid level which is shown as an alternate liquid level at 53.

An appropriately sized surge volume is an important feature in this invention. The space above the cores 42, 44, and 46 is a liquid/vapor disengaging zone 58.

Referring now to FIG. 1, liquid level transmitter 60 in combination with a level sensor (not illustrated) operatively connected to the discharge zone 56 provides an output signal 62 that represents the actual liquid level in the discharge zone 56. Signal 62 is provided as a process variable input to level controller 64. Level controller 64 is also provided with a set point signal 66 that represents a desired level for discharge zone 56. In response to signals 62 and 66, level controller 64 provides an output signal 68 that represents the difference between signals 62 and 66. Signal 68 is scaled to represent the position of control valve 34 required to maintain the actual liquid level in the discharge zone 56 substantially equal to the desired level represented by signal 66. Signal 68 is provided as a control signal to control valve 34, and control valve 34 is manipulated responsive to signal 68.

The intermediate-stage propane heat exchanger shell 70 is operated in the same manner as the high-stage shell 40. The pressure of the liquid propane refrigerant is again reduced, as through control valve 72, so as to flash another portion of the liquid propane to cool the entire stream flowing into the intermediate stage propane heat exchange shell 70. The gaseous portion passes through the shell vapor space and exits the shell 70 via conduit 88. The liquid portion is collected in the shell 70 to form a liquid level that is maintained at or above a minimum level. The liquid in shell 70 is circulated by thermosiphon circulation to contact the cores 82, 84, and 86. Approximately 25 to 30 percent of the thermosiphon circulated fluid evaporates providing the cooling for indirect heat exchange with the natural gas feed stream via plate-fin-core 82, ethylene refrigerant in plate-fin-core 84, and methane in plate-fin-core 86. The evaporated gas is returned to the intermediate stage inlet 14 of compressor 10 via conduit 88. The weir type baffle 74 is positioned in the shell 70 to facilitate maintenance of a minimum functional liquid level for the cores 82, 84 and 86, and to divide the shell 70 into zones 76 and 78, which are analogous to zones 54 and 56 in shell 40. Level transducer 90, level controller 94, and set point signal 92 produce a control signal 96 to manipulate valve 72 in the same manner as signal 68 manipulates valve 34.

The low stage shell 100 differs from the high-stage shell 40 and intermediate-stage shell 70 in omitting the weir type baffle that divides shells 40 and 70 into heat exchange zones and discharge zones. Space required for vapor compression refrigeration service in each zone may differ, as will be illustrated in an example hereinafter showing pressure, temperature, flow rates, composition, etc., for the high-stage propane core-in-shell exchanger for a simulated LNG manufacture process.

The pressure of the liquid propane refrigerant is again reduced, as through control valve 102, so as to flash another portion of the liquid propane to cool the entire stream into the low-stage propane heat exchange shell 100. The gaseous portion passes through the shell vapor space and exits the shell 100 via conduit 108. Liquid collected in the shell evaporates providing the cooling for indirect heat exchange with natural gas feed via plate-fin-core 103, ethylene refrigerant via plate-fin-core 104 and methane refrigerant via plate-fin-core 106. The evaporated gas is returned to the low-stage inlet 12 of compressor 10 via conduit 108. Level transducer 110, level controller 114 and set point signal 112 produce control signal 116 to manipulate control valve 102 in the same manner as signal 68 manipulates valve 34 to maintain a desired liquid level.

CALCULATED EXAMPLE

The following table is presented further to illustrate the present invention through specification of temperatures, pressures, flow rates, composition, etc., of heat exchanger input streams 20, 31, 41 and 36, and heat exchanger output streams 21, 33, 43, 53, and 58 associated with the high-stage propane heat exchanger illustrated at reference numeral 40 in FIG. 1. The gas to be cooled is a dry natural gas. A typical feed stream, illustrated at 20 in FIG. 1, is assumed for a computer simulated operation of a plant designed to produce LNG of 1.1 million metric tones per annum. By specifying all services for the respective refrigerant stage (e.g., feed gas, ethylene and recycle methane) be contained in a single shell, cost for cold boxes, piping, and core-in-shell heat exchangers are significantly reduced. By adding the surge volume and withdrawing refrigerant to the next lower stage core-in-shell heat exchanger from the surge section of the next higher stage shell, major upsets in high-stage exchangers resulting from low-stage minor upsets are prevented.

HIGH-STAGE PROPANE
BRAZED-ALUMINUM PLATE-FIN HEAT EXCHANGER SPECIFICATIONS

| DESCRIP- | INLET STREAMS | | | | OUTLET STREAMS | | | | |
|---|---|---|---|---|---|---|---|---|---|
| TION | 20 | 31 | 41 | 36 | 21 | 33 | 43 | 53 | 48 |
| Vapour Fraction | 1 | 1 | 1 | 0.180 | 0.997 | 1 | 1 | 0 | 1 |
| Temp., °F. | 100.4 | 100.4 | 100.4 | 59 | 63 | 63 | 63 | 59 | 60 |
| Pressure, psia | 595 | 270 | 567 | 107 | 589 | 266 | 562 | 107 | 107 |
| Molar Flow, lb mole/hr | 22,038 | 20,761 | 15,969.98 | 30,220 | 22,038.44 | 20,761.92 | 21,232.04 | 8,988,48 | |
| Mass Flow, lb/hr | 390,583 | 579,957 | 259,011.90 | 1,330,000 | 390,583,30 | 579,957 | 11.90 | 937,514.00 | 395,120.30 |
| Liq. Vol. Flow, barrel/day | 84,405 | 103,790 | 58,654.02 | 180,381 | 84,405.07 | 103,790.30 | 58,654.02 | 126,769.30 | 53,611.66 |
| Enthalpy, Btu/hr | 9.60E+07 | 9.27E+07 | 6.82E+07 | 1.09E+07 | 8.67E+07 | 8.34E+07 | 6.25E+07 | −1.77E+07 | 5.23E+07 |
| Density, lb/ft$^3$ | 1.926 | 1.4078 | 1.642 | 4.832 | 2.1008 | 1.53 | 1.7797 | 31.7053 | 0.9923 |
| Mol. Weight | 17.72 | 27.9337 | 16.219 | 44.097 | 17.723 | 27.934 | 16.219 | 44.156 | 43.959 |
| Specific Heat, Btu/lb · °F. | 0.589 | 0.4353 | 0.594 | 0.598 | 0,594 | 0.438 | 0.5954 | 0.629 | 0.460 |
| Thermal Conductivity, Btu/hr · ft · °F. | 0.022 | 0.0142 | 0.0224 | — | — | 0.0131 | 0.0208 | 0,058 | 0.0102 |

| DESCRIP- | INLET STREAMS | | | | OUTLET STREAMS | | | | |
|---|---|---|---|---|---|---|---|---|---|
| TION | 20 | 31 | 41 | 36 | 21 | 33 | 43 | 53 | 48 |
| Nitrogen, mole frac. | 0.001 | 0.000 | 0.007 | 0.000 | 0.001 | 0.000 | 0.007 | 0.000 | 0.000 |
| Methane, mole frac. | 0.933 | 0.010 | 0.987 | 0.000 | 0.933 | 0.010 | 0.987 | 0.000 | 0.000 |
| Ethane, mole frac. | 0.036 | 0.000 | 0.006 | 0.010 | 0.036 | 0.000 | 0.006 | 0.007 | 0.017 |
| Ethylene, mole frac. | 0.000 | 0.990 | 0.000 | 0.000 | 0.000 | 0.990 | 0.000 | 0.000 | 0.000 |
| Propane, mole frac. | 0.015 | 0.000 | 0.000, | 0.980 | 0.015 | 0.000 | 0.000 | 0.982 | 0.976 |
| i-Butane, mole frac. | 0.003 | 0.000 | 0.000 | 0.010 | 0.003 | 0.000 | 0.000 | 0.011 | 0.007 |
| n-Butane, mole frac. | 0.004 | 0.000 | 0.000 | 0.000 | 0.004 | 0.000 | 0.000 | 0.000 | 0.000 |
| i-Pentane, mole frac. | 0.001 | 0.000 | 0.000 | 0.000 | 0.001 | 0.000 | 0.000 | 0.000 | 0.000 |
| n-Pentane, mole frac. | 0.001 | 0.000 | 0.000 | 0.000 | 0.001 | 0.000 | 0.000 | 0.000 | 0.000 |
| n-Hexane, mole frac. | 0.002 | 0.000 | 0.000 | 0.000 | 0.002 | 0.000 | 0.000 | 0.000 | 0.000 |
| n-Heptane, mole frac. | 0.001 | 0.000 | 0.000 | 0.000 | 0.001 | 0.000 | 0.000 | 0.000 | 0.000 |

Thus the embodiment of the present invention realizes new and useful apparatus and method for cooling a normally gaseous material by utilizing plate-fin core-in-shell heat exchangers having an appropriate surge volume with a multistage refrigeration compressor. While the present invention has been described in terms of specific materials, conditions of operation and equipment, it is to be recognized that reasonable variations and modifications are possible by those skilled in the arts which are within the scope of the described invention and the appended claims.

That which is claimed:

1. Apparatus for cooling a normally gaseous feed stream, comprising:

(a) a multistage compressor having at least a high-stage section and a low-stage section;

(b) heat exchange means for condensing refrigerant gas compressed in said multistage compressor to produce a liquid refrigerant;

(c) an elongated high-stage heat exchange shell associated with said high-stage section of said multistage compressor, said high-stage heat exchange shell having a volume sufficient for handling vapor-compression refrigeration service for said high-stage compressor section, and additionally having a surge volume;

(d) at least one high-stage plate-fin-core disposed in said high-stage shell, said core being operable over a range of liquid levels in said high-stage shell;

(e) a baffle plate transversely disposed in said high-stage shell so as to facilitate maintenance of a minimum liquid level for said plate fin core;

(f) means for flashing said liquid refrigerant into said high-stage shell and producing a first mixture of gas and liquid in which said feed gas stream passes in indirect heat exchange through said high-stage plate-fin-core;

(g) means for separating said first mixture of gas and liquid and providing said gas to an inlet of said high-stage compressor section, and holding sufficient liquid in said high-stage shell to provide at least a minimum functional liquid level for said high-stage core;

(h) an elongated low-stage heat exchange shell associated with said low-stage section of said multistage compressor, said low-stage heat exchange shell containing at least one low-stage plate-fin-core, said low-stage shell having a volume sufficient for handling vapor-compression refrigeration service for said low-stage compressor section;

(i) means for flashing said liquid refrigerant withdrawn from said surge volume into said low-stage shell to produce a second mixture of gas and liquid in which said feed gas stream passes in indirect heat exchange through said low-stage plate-fin-core;

(j) means for separating said second mixture of gas and liquid in said low-stage shell and providing said gas to an inlet of said low-stage compressor section and holding sufficient liquid in said low-stage shell to provide at least a minimum functional liquid level for said low-stage core; and (k) wherein said surge volume in said high-stage shell is a volume equal to a level fluctuation in said low-stage shell of about four inches to about eight inches.

2. Apparatus in accordance with claim 1, wherein said high-stage shell includes an additional volume defined by said baffle plate and the nearest end wall of said high-stage shell, and wherein said surge volume is defined by said additional volume in combination with the volume defined by said liquid level range in said high-stage shell.

3. Apparatus according to claim 1, wherein said cores in said plate-fin-core-in-shell heat exchanger comprise brazed-aluminum-plate-fin cores, and said elongated high-stage heat exchange shell contains a plurality of said cores.

4. Apparatus according to claim 1, wherein said multistage compressor comprises at least three compression stages.

5. Apparatus in accordance with claim 1, wherein said normally gaseous feed stream comprises natural gas.

6. Apparatus in accordance with claim 4, wherein said surge volume comprises a volume equal to a fluctuation in the largest downstream shell of from about five inches to about seven inches and preferably about six inches.

7. Apparatus in accordance with claim 1, wherein said refrigerant comprises propane, and said apparatus additionally includes multistage compressors and associated plate-fin-in-core heat exchanger for ethylene and methane refrigerants in a cascade cooling operation.

8. Apparatus in accordance with claim 7, wherein said liquid refrigerant is flashed into said elongated low-stage shell from said surge volume, said apparatus additionally comprising:

means for controlling the liquid level in said surge volume by manipulating the flow rate of said liquid refrigerant flashed into said elongated high-stage shell.

9. A method for cooling a normally gaseous material which comprises the step of providing a process stream of said normally gaseous material to an apparatus comprising:

(a) a multistage compressor having at least a high-stage section and a low-stage section;

(b) a heat exchange means for condensing refrigerant gas compressed in said multistage compressor to produce a liquid refrigerant;

(c) an elongated high-stage heat exchange shell associated with said high-stage section of said multistage compressor, said high-stage heat exchange shell having a volume sufficient for handling vapor compression refrigeration service for said high-stage compressor section, and having a surge volume;

(d) at least one high-stage plate-fin-core, said core being operable over a range of liquid levels in said high-stage shell;

(e) a baffle plate transversely disposed in said high-stage shell to facilitate maintenance of a minimum liquid level for said high-stage plate-fin-cores;

(f) means for flashing said liquid refrigerant into said high-stage shell to produce a first mixture of gas and liquid in which said feed gas stream passes in indirect heat exchange through said high-stage plate-fin-core;

(g) means for separating said first mixture of gas and liquid and providing said gas to an inlet of said high stage compressor section, and holding sufficient liquid in said high-stage shell to provide at least a minimum functional liquid level for said high-stage core;

(h) an elongated low-stage heat exchange shell associated with said low-stage section of said multistage compressor, said low-stage heat exchange shell containing at least one low-stage plate-fin-core, said low-stage shell having a volume sufficient for handling the vapor- compression refrigeration service for said low-stage compressor section;

(i) means for flashing said liquid refrigerant withdrawn from said surge volume into said low-stage shell to produce a second mixture of gas and liquid in which said feed gas stream passes in indirect heat exchange through said low-stage plate-fin-core;

(j ) means for separating said second mixture of gas and liquid in said low-stage shell and providing said gas to an inlet of said low-stage compressor section and holding sufficient liquid to provide a level in said low-stage shell; and (k) wherein said surge volume in said high-stage shell is a volume equal to a level fluctuation in said low-stage shell of about four inches to about eight inches.

10. A method in accordance with claim 9, wherein said refrigerant is propane, said method additionally comprising the step of:

controlling the liquid level in said surge volume by manipulating flow of said liquid refrigerant into said high-stage shell.

11. A method in accordance with claim 9, wherein said normally gaseous feed stream comprises natural gas, and said refrigerant comprises propane.

12. A method in accordance with claim 11, additionally comprising the following step:

providing a cascade cooling scheme for said feed stream, wherein said feed stream is first cooled by propane in said multistage compressor, followed by a cooling cycle using ethylene refrigerant and finally a cooling cycle using methane refrigerant to liquefy said feed stream.

13. A method in accordance with claim 12, wherein said multistage compressor comprises at least three compression stages, and said elongated heat exchange shell associated with said high-stage compression section includes a plurality of said cores.

14. A method in accordance with claim 13, wherein said high-stage shell contains a first, a second and a third plate-fin-core, said method additionally comprising:

passing said feed stream through said first plate-fin-core for indirect heat exchange with said first mixture of gas and liquid;

passing ethylene refrigerant through said second plate-fin-core for indirect heat exchange with said first mixture of gas and liquid; and passing methane refrigerant through said third plate-fin-core for indirect heat exchange with said first mixture of gas and liquid.

* * * * *